United States Patent [19]

Woenker

[11] Patent Number: 4,500,046

[45] Date of Patent: Feb. 19, 1985

[54] STRIP MATERIAL TAKE-UP APPARATUS

[75] Inventor: William E. Woenker, Pierceton, Ind.

[73] Assignee: Chem-Elec, Inc., North Webster, Ind.

[21] Appl. No.: 443,649

[22] Filed: Nov. 22, 1982

[51] Int. Cl.[3] ..... B65H 23/20

[52] U.S. Cl. ..... 242/67.1 R; 242/68.4; 242/75.5

[58] Field of Search ..... 242/67.1 R, 68.1, 68.2, 242/68.4, 72 R, 72.1, 75.5, 75.51

[56] References Cited

U.S. PATENT DOCUMENTS

| | | | |
|---|---|---|---|
| 138,947 | 5/1873 | Smith | 242/72.1 |
| 778,979 | 1/1905 | Larson | 242/68.4 |
| 915,111 | 3/1909 | Price . | |
| 1,281,861 | 10/1918 | Sibley | 242/72.1 |
| 2,297,648 | 9/1942 | Cushman | 242/72.1 |
| 2,708,256 | 5/1955 | Colt | 318/6 |
| 3,113,742 | 12/1963 | Bevan . | |
| 3,157,405 | 11/1964 | Hafemeister | 242/68.2 |
| 3,338,531 | 8/1967 | Novotny | 242/67.1 R X |
| 3,395,870 | 8/1968 | Klinger | 242/72 |
| 3,977,621 | 8/1976 | Huffman | 242/75.5 |
| 4,061,287 | 12/1977 | Shakespeare . | |
| 4,116,400 | 9/1978 | Jones . | |

*Primary Examiner*—John M. Jillions
*Assistant Examiner*—Lloyd D. Doigan
*Attorney, Agent, or Firm*—Roger M. Rickert

[57] ABSTRACT

A device for rolling up strip material such as paper on a reel or spool for temporary storage purposes, which maintains a relatively uniform tension on the strip material regardless of the movement of that strip material, is disclosed and employs an electric motor which exerts a substantially constant torque independent of the speed of motor operation, which motor is positively drivingly coupled to an expanded mandrel for receiving the strip material. When the mandrel strip material capacity is reached, it may be removed and an end flange extracted therefrom allowing the mandrel to collapse, facilitating the removal of the roll of strip material. In a preferred embodiment, the positive drive is achieved by a toothed timing belt in conjunction with a pair of corrugated pulleys, one coupled to the motor rotor and the other journalled in axial alignment with the mandrel. In this preferred form, the mandrel or spool is formed as a hollow cylindrical core, slotted axially part way therealong with peripherally adjacent slots extending from opposite core ends and with a pair of constricting O-rings surrounding the core so as to collapse the slots. A pair of reel ends or flanges each having an axle portion insertable into the cylindrical core so as to expand that core somewhat against the constricting force aid removal of wound strip material from the mandrel.

6 Claims, 7 Drawing Figures

STRIP MATERIAL TAKE-UP APPARATUS

BACKGROUND OF THE INVENTION

Field of the Invention

The present invention relates generally to an apparatus for rewinding strip material as that material becomes available and more particularly to a comparatively simple arrangement for taking up such strip material in environments where the strip material becomes available for rewinding during irregularly occurring intervals and at variable speeds during those intervals. Even more particularly, the present invention relates to a strip take-up apparatus which exerts a relatively constant tension on the strip material regardless of the material feed rate.

A number of diverse strip material take-up reel arrangements are known and typically these arrangements are integral with the device making the strip material available. Classic examples are incorporated in magnetic tape recorders, motion picture projectors, cash registers which maintain a paper tape record of all transactions and conventional typewriter ribbon mechanisms, as well as numerous special purpose machines such as medical and seismic recording machines.

There are also a number of types of machines which generate strip material such as a paper tape printed output from a computer or calculator, as well as the printed output of automated typewriters and other business machines. The problem of retention and storage of such strip material records remains in part unsolved and the number of different attempts to take-up and store such strip material bears eloquent testimony to the unsolved nature of the problem. The auxiliary strip material rereeling proposals heretofore typically employ some sort of clutching mechanism between a power source and a take-up reel to compensate for variations in the rate of strip material movement. Such clutching arrangements are subject to wear, particularly when strip material movement ceases yet the drive continues. Such strip material take-up arrangements also typically employ a core about which the material is to be wound and when removing a reel of strip material, a new core must be positioned in the device preparatory to receiving additional material. The prior art attempts have also typically been relatively expensive and complex both from a maintenance and a user's point of view. It therefore would be highly desirable to provide an operationally simplistic and economical strip material take-up apparatus adaptable to a wide variety of paper and similar strip material handling problems.

SUMMARY OF THE INVENTION

Among the several objects of the present invention may be noted the elimination of the above-mentioned defects and achievement of the above-mentioned goals; obviating clutch wear and the associated problems in typical take-up reel devices; facilitating removal of a roll of strip material from the mandrel or arbor about which that material has been rolled; and the provision of a strip material take-up apparatus characterized by its ease and economy of manufacture and maintenance as well as its adaptability to a wide variety of strip material take-up problems. These as well as other objects and advantageous features of the present invention will be in part apparent and in part pointed out hereinafter.

In general, a strip material take-up apparatus includes a drive motor having an applied voltage-dependent torque which is substantially independent of the speed of operation of the motor, positively drivingly coupled to an expandable mandrel for receiving, in its expanded condition, the strip material so that the mandrel may wind strip material thereabout as the material becomes available, while maintaining a substantially constant tension on the strip of material in a manner independent of strip material movement.

Also in general and in one form of the invention, the strip material take-up apparatus includes a hollow cylindrical core with expansion slots extending axially from one end face thereof toward and terminating short of the opposite core end face with peripherally adjacent slots extending from opposite core end faces, along with a pair of end flanges having axle portions insertable into the cylindrical core to expand the slots against a circumferentially constricting force so that removal of the end flanges allows collapse of the core and the easy removal of strip material wound thereabout. A drive arrangement which imparts a substantially constant torque to the strip material receiving reel and an operator actuable control for varying that torque are also provided.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
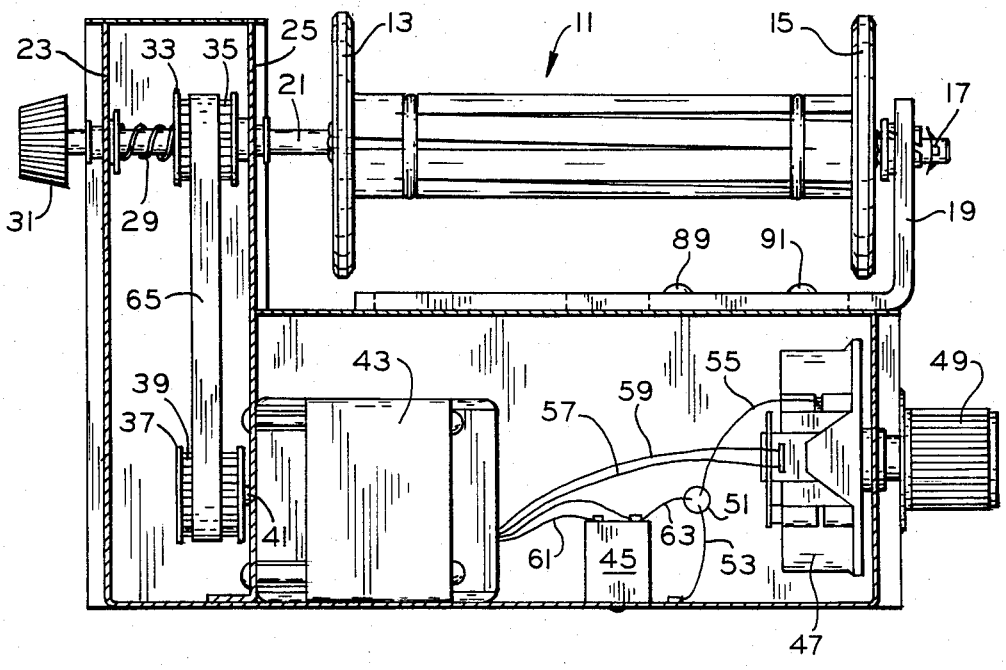
FIG. 1 is a side elevation view of a strip material take-up device with a portion of the housing removed to illustrate the internal parts thereof.
Figure 2:
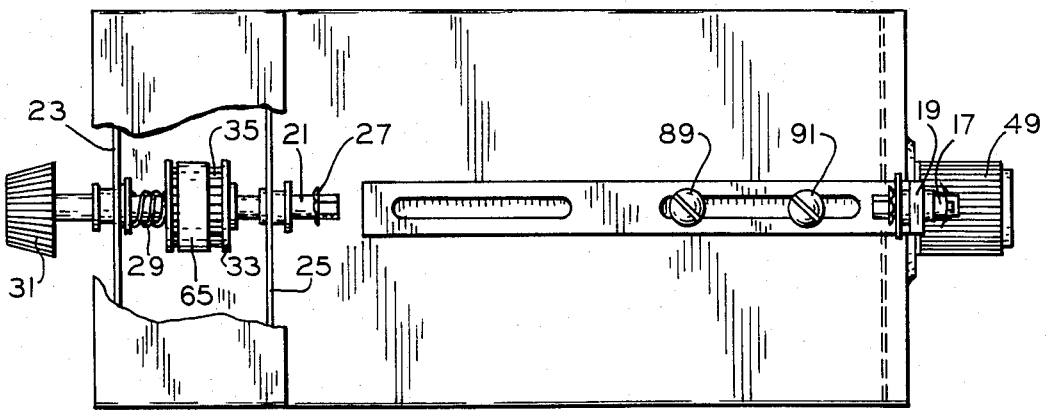
FIG. 2 is a plan view of the apparatus of FIG. 1 partly broken away and with the take-up reel removed.

Referring first to FIGS. 1 and 2, the strip material take-up apparatus of the invention is seen to include an expandable mandrel 11 which is in its expanded state whenever end flanges 13 and 15 are in position as illustrated in FIG. 1. In this state the mandrel is ready to receive strip material such as paper fed from an intermittently operating business machine. Mandrel 11 is supported for rotation about its axis at one end by shaft 17 rotationally supported in bracket 19 and engaging a hole in the outer end face of flange 15 while flange 13 has a similar opening for receiving shaft 21. For example, the shafts 21 and 17 may be provided with hexagonally shaped heads and the respective flanges 13 and 15 may be provided with mating hexagonal holes.

Shaft 21 is supported by bearings in the upright members 23 and 25, respectively, and may move axially within those bearings toward the right as limited by engagement of the shaft 21 with mandrel 11 while leftward movement, as viewed, is limited by engagement between upright member 25 and shaft supported snap-ring 27 as shown in FIG. 2. Shaft 21 is biased toward the right, as viewed, by a coil spring 29 so that an operator may grip and pull shaft knob 31 toward the left to disengage shaft 21 from flange 13 whereupon the mandrel 11 is moved toward the left slightly to disengage shaft 17 from flange 15 with removal of the mandrel and subsequent replacement being readily accomplished by operator compression of the spring 29 and simple alignment or removal of the respective shafts and flange openings. Shaft 21 also has fixed thereto a drive wheel or pulley 33 having a corrugated or toothed peripheral surface 35.

A similar drive wheel 37 and corrugated drive surface 39 is fixed to the shaft 41 of the rotor of electric drive motor 43. Drive wheels 33, 37 are drivingly connected by toothed drive belt 65. Thus rotation of the motor rotor positively drives mandrel 11 as illustrated in FIG. 1. Drive motor 43 is of a type which exerts a relatively constant rotor torque substantially independent of the motor speed of operation even in a totally stalled condition. While called relatively constant herein, such motors frequently exhibit maximum torque in a stalled condition with that torque falling off somewhat as the speed increases. Such motors are commercially available and a KC1-26 Model 621 motor manufactured by Bodine Electric Company of Chicago, Ill., has been successfully used in a preferred embodiment. For example, a polyphase hysteresis motor may be connected for single phase operation, using a phase splitting capacitor 45. Other types of induction motors may also be used. While rotor torque is nearly independent of the speed of rotation of the rotor, this torque varies directly with the applied voltage approximately as the square of that voltage and a rheostat 47 with operator actuable control knob 49 may be connected in the circuit so that the operator may select a preferred strip material tension for a specific task. As illustrated in FIG. 1, a three conductor single phase alternating current source line passes through grommet 51 with conductor 53 grounded for safety reasons and line 55 connected to one terminal of rheostat 47. The other terminal of rheostat 47 is connected by way of lines 57 and 59 to one side of each phase of a two phase stator winding within the motor 43. The other lead for one phase is coupled by way of conductor 61 to one side of the capacitor 45 while the remaining lead for the other phase is connected to the other terminal of capacitor 45 and thence to the other power input lead 63. Thus, the operator may, by manipulating control knob 49, vary the voltage applied to the motor 43 thereby controlling the rotor torque thereof and, by way of timing belt 65, also controlling the tension on strip material being wound about the arbor or mandrel 11. This mandrel or arbor functions as the strip material accumulation reel and the details thereof are best seen in FIGS. 3 through 7.

Figure 3:
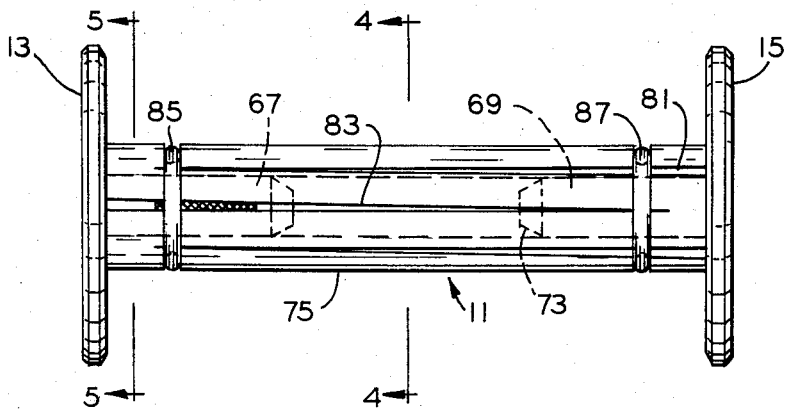
FIG. 3 is a side elevation view of the take-up reel of FIG. 1.
Figure 4:
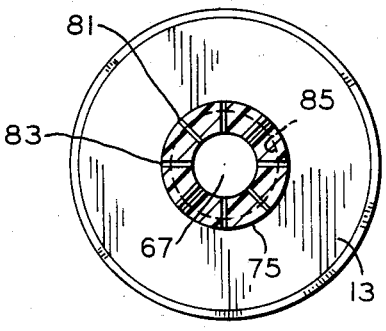
FIG. 4 is a view in cross section along line 4—4 of FIG. 3.
Figure 5:
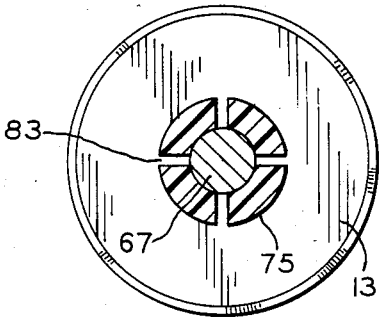
FIG. 5 is a view in cross section along line 5—5 of FIG. 3.
Figure 6:
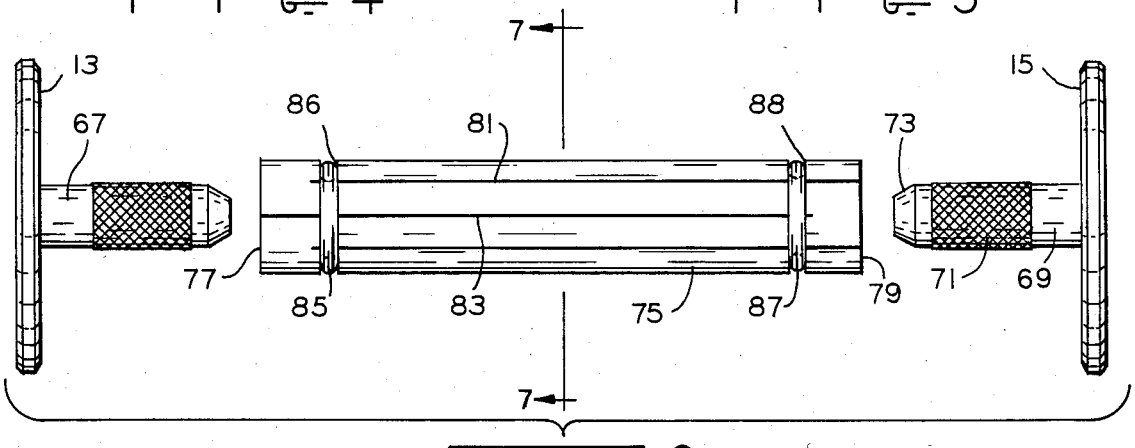
FIG. 6 is a view similar to FIG. 3 but illustrating the axles of the end flanges removed from the hollow cylindrical core.
Figure 7:
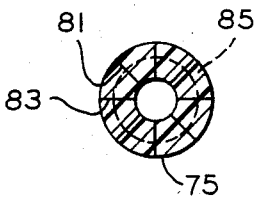
FIG. 7 is a view in cross section along the lines 7—7 of FIG. 6.

Referring primarily to FIG. 6, the arbor 11 includes flanges 13 and 15 having respective axles 67 and 69 which may include a non-slip surface as at 71 and a taper 73 to facilitate entry of the axles into the cylindrical core 75. The hollow cylindrical core 75 is provided with eight axially extending slots as illustrated, which slots extend from end faces 77 and 79, respectively, of the core toward the opposite end face, however, the slots terminate short of the opposite end face so that adjacent slots such as 81 and 83 extend in opposite directions from opposite core end faces. A pair of O-rings 85 and 87 in circumferential slots 86, 88, respectively, tend to constrict the cylindrical core 75, closing the respective slots as depicted in FIGS. 6 and 7. Positioning the axles 67 and 69, as illustrated in FIG. 3, expands the core 75 against the circumferentially constricting force of O-rings 85 and 87, expanding the slots as illustrated in FIGS. 4 and 5. Thus with the axles in position within the cylindrical core, paper or other strip material may be wound about that core and thereafter the operator may remove the two end flanges 13 and 15 causing the cylindrical core to collapse, allowing its free removal from a reel of strip material for reuse.

Thus, from a user's point of view, control knob 49 selects a speed independent torque and, therefore, a speed independent tension on the strip material being received while knob 31 functions as a release mechanism for placement or removal of the arbor 11. Simple removal of the axles 67 and 69 collapses the cylindrical core 75 to release it from an accumulated roll of strip material. Adaptation of the device to accumulate strip material of various widths may in some cases require the use of a reel of different axial length, and bracket 19 may be moved relative to the remaining apparatus by simply loosening screws 89 and 91.

From the foregoing it is now apparent that a novel strip material take-up apparatus meeting the objects and advantageous features set out hereinbefore as well as others has been disclosed and that modifications as to the precise configurations, shapes and details may be made by those having ordinary skill in the art without departing from the spirit of the invention or the scope thereof as set out by the claims which follow.

What is claimed is:

1. Strip material take-up apparatus comprising in combination:

an electric drive motor for exerting a relatively constant rotor torque substantially independent of the motor speed of operation, the drive motor torque being directly related to the magnitude of the voltage applied thereto;

a rheostat coupling the drive motor to a source of electrical energy and operator controllable to allow a user to select the magnitude of the voltage applied to the drive motor and therefore also the speed independent torque and the strip material tension;

an expandible mandrel for receiving, in its expanded condition, strip material, the mandrel comprising a hollow cylindrical core having axially extending slots extending from an end face of the core toward and terminating short of the opposite end face of the core with adjacent slots extending in opposite directions from opposite core end faces; and means positively drivingly coupling the motor and mandrel in a slip-free manner to wind strip material about the mandrel as that material becomes available while maintaining tension on the strip material substantially constant independent of strip material movement;

first manually operable release means for allowing removal of the mandrel from the apparatus; and second manually operable release means effective in a first state to maintain the mandrel in its expanded condition and effective in a second state to allow the mandrel to collapse somewhat to facilitate removal of strip material from the mandrel.

2. The apparatus of claim 1 said second release means comprising a pair of end flanges each having an axle portion insertable into the cylindrical core.

3. The apparatus of claim 2 further comprising means circumferentially constricting the cylindrical core urging the inner surface thereof into engagement with the flange axle portions with the axially extending slots gapping somewhat so that removal of axles from the cylindrical core allows the slots to close under the constricting force reducing the outside diameter of the cylindrical core.

4. The apparatus of claim 1 wherein the means coupling the motor and mandrel includes a first drive wheel having a corrugated drive surface and fixed to the motor rotor for rotation therewith, a second drive wheel having a similarly corrugated drive surface, a flexible band having corrugations for mating with the drive wheel surfaces to co-rotationally couple the drive wheels together, a shaft coaxially aligned with the mandrel, rotationally supported and axially movable into and out of driving engagement with the mandrel, the second drive wheel being supported on said shaft for rotation therewith, and spring means normally biasing the shaft axially into driving engagement with the mandrel.

5. The apparatus of claim 4 further comprising support bearing means coaxial with said shaft and mandrel for rotationally supporting the mandrel end opposite said shaft, said first release means comprising a manually operable release knob fixed to the shaft and movable by an operator against the spring biasing to disengage the shaft from the mandrel to allow removal of the mandrel from the apparatus.

6. Strip material take-up apparatus comprising in combination:

a hollow cylindrical core having expansion slots extending axially from an end face of the core and terminating short of the opposite core end face with peripherally adjacent slots extending in opposite directions from opposite core end faces;

a pair of end flanges each having an axle portion insertable into the cylindrical core;

means circumferentially constricting the cylindrical core urging the inner surface thereof into engagement with the flange axle portions with the axially extending slots gapping somewhat so that removal of axles from the cylindrical core allows the slots to close under the constricting force reducing the outside diameter of the cylindrical core;

drive means for imparting a selected substantially speed independent torque to the core by way of one end flange including an electric drive motor having a torque directly related to the magnitude of the voltage applied thereto for exerting a relatively constant voltage determined rotor torque substantially independent of rotor speed, a first drive wheel having a corrugated drive surface fixed to the motor shaft for rotation therewith, a second drive wheel having a corrugated drive surface, a flexible band having corrugations for mating with the drive wheel surfaces to corotationally couple the drive wheels in a slip-free manner, a shaft rotationally supported in axial alignment with the cylindrical core and axially movable into and out of driving engagement with an end flange inserted in the core, the second drive wheel being fixed to said shaft for rotation therewith, and spring means for biasing the shaft axially into driving engagement with the end flange; and a rheostat coupling the drive motor to a source of electrical energy and operator controllable to allow a user to select the magnitude of the voltage applied to the drive motor and therefore also the motor torque and strip material tension.

* * * * *